US010479658B2

(12) United States Patent
Zhang et al.

(10) Patent No.: US 10,479,658 B2
(45) Date of Patent: Nov. 19, 2019

(54) TELESCOPIC DEVICE OF SINGLE-CYLINDER LATCH TYPE AND CRANE

(71) Applicant: XUZHOU HEAVY MACHINERY CO., LTD., Xuzhou, Jiangsu Province (CN)

(72) Inventors: Haiyan Zhang, Xuzhou (CN); Xiaodong Hu, Xuzhou (CN); Caobin Lu, Xuzhou (CN); Jingwen Liang, Xuzhou (CN)

(73) Assignee: Xuzhou Heavy Machinery Co, Ltd., Xuzhou (CN)

( * ) Notice: Subject to any disclaimer, the term of this patent is extended or adjusted under 35 U.S.C. 154(b) by 369 days.

(21) Appl. No.: 15/312,310

(22) PCT Filed: May 20, 2014

(86) PCT No.: PCT/CN2014/077838
§ 371 (c)(1),
(2) Date: Nov. 18, 2016

(87) PCT Pub. No.: WO2015/176218
PCT Pub. Date: Nov. 26, 2015

(65) Prior Publication Data

US 2017/0081156 A1 Mar. 23, 2017

(51) Int. Cl.
*B66C 23/70* (2006.01)

(52) U.S. Cl.
CPC ..... *B66C 23/708* (2013.01); *B66C 23/701* (2013.01)

(58) Field of Classification Search
CPC ..... B66C 23/62; B66C 23/701; B66C 23/708
See application file for complete search history.

(56) References Cited

U.S. PATENT DOCUMENTS 4,688,689 A * 8/1987 Barsuhn ..... B66C 23/708 212/264
5,628,416 A * 5/1997 Frommelt ..... B66C 23/705 212/292

(Continued)

FOREIGN PATENT DOCUMENTS

CN 101214909 7/2008
CN 101214910 7/2008

(Continued)

OTHER PUBLICATIONS

Communication pursuant to Article 94(3) EPC for EP Application No. 14 892 857.5 dated Nov. 9, 2018, 6 pages.

(Continued)

*Primary Examiner* — Michael E Gallion
(74) *Attorney, Agent, or Firm* — Myers Bigel, P.A.

(57) ABSTRACT

The present invention relates to a telescopic device of single-cylinder latch type and a crane. The telescopic device of single-cylinder latch type is applied to a telescopic boom system and includes: a telescopic cylinder, for driving telescopic boom sections of the telescopic boom system to execute a telescopic action relative to a basic boom section; double boom pin structures, arranged on both sides of the tails of the telescopic boom sections to lock and unlock the telescopic boom sections; an boom pin pulling and plugging mechanism, arranged on the cylinder barrel of the telescopic cylinder to execute pulling and plugging operations on the double boom pin structures; and a cylinder pin structure and a cylinder pin cylinder, both arranged on the cylinder barrel of the telescopic cylinder and to lock and unlock the cylinder barrel of the telescopic cylinder and the telescopic boom sections. In the present invention, the double boom pin structures are arranged on both sides of the tails of the telescopic boom sections, compared with the existing upper boom pin solution, the double boom pin structures in the (Continued)

present invention are arranged on both sides of the telescopic boom sections, so that the stress is more uniform compared with a structure which is singly arranged on the upper side of a telescopic boom, and the influence of flexural deformation of a telescopic boom on the position of a pin hole and the stress of an boom pin is reduced.

12 Claims, 2 Drawing Sheets

(56) References Cited

U.S. PATENT DOCUMENTS

| | | | | |
|---|---|---|---|---|
| 6,164,468 | A | 12/2000 | Erdmann | |
| 6,216,895 | B1 * | 4/2001 | Erdmann | B66C 23/708 212/292 |
| 2001/0052506 | A1 * | 12/2001 | Richter | B66C 23/705 212/177 |
| 2003/0057172 | A1 * | 3/2003 | Harrington | B66C 23/705 212/292 |

FOREIGN PATENT DOCUMENTS

| | | |
|---|---|---|
| CN | 201161879 | 12/2008 |
| CN | 201161882 | 12/2008 |
| CN | 201944059 | 8/2011 |
| CN | 103950848 | 7/2014 |
| DE | 10004868 | 9/2000 |
| EP | 2392536 | 12/2011 |

OTHER PUBLICATIONS

Extended European Search Report for corresponding EP application No. 14892857.5 dated Nov. 14, 2017, 6 pages.

Communication pursuant to Article 94(3) EPC for EP Application No. 14 892 857.5 dated Jun. 19,2019, 5 pages.

* cited by examiner

TELESCOPIC DEVICE OF SINGLE-CYLINDER LATCH TYPE AND CRANE

RELATED APPLICATIONS

The present application is a 35 U.S.C. § 371 national phase application of PCT International Application No. PCT/CN2014/077838, filed May 20, 2014; the disclosure of which is hereby incorporated herein by reference in its entirety. PCT International Application No. PCT/CN2014/077838 is published in Chinese as PCT Publication No. WO 2015/176218.

FIELD OF THE INVENTION

The present invention relates to the field of engineering machinery, and particularly relates to a telescopic device of single-cylinder latch type and a crane.

BACKGROUND OF THE INVENTION

In a telescopic boom telescopic system with more than six boom sections, since a rope aligning mechanism is relatively complex to use, a telescopic device of single-cylinder latch type is commonly used at present. The so-called telescopic device of single-cylinder latch type is a mechanism which adopts a single telescopic cylinder to achieve extension and retraction of a telescopic boom, and the extension and retraction of the telescopic boom are achieved by the cooperation of cylinder pin and boom pins.

The existing telescopic device of single-cylinder latch type mainly adopts an upper boom pin solution. Namely, a boom pin is mounted at the upper part of each boom section except a basic boom section, and a T-shaped groove is driven by two boom pin cylinders to move up and down to plug in and pull out the boom pin, the two boom pin cylinders are symmetrically distributed on the head of the T-shaped groove. Due to space limitation, there is a certain distance between a point of action of the cylinder and the force bearing point of the T-shaped groove, i.e., there is a certain unbalance loading torque, resulting in that the boom pin cylinders bear an unbalance loading force. If working under the unbalance loading force for a long time, the boom pin cylinders will be subject to an oil leakage phenomenon resulting from seal wear and crush.

According to the existing telescopic device of single-cylinder latch type, in the case of larger flexural deformation of a telescopic boom, an boom pin hole of the telescopic boom is deformed due to the flexibility of the telescopic boom, so that when the boom pin is plugged in and pulled out, the boom pin is subject to a misalignment problem with the boom pin hole of the telescopic boom, which will cause the problem that the boom pin is difficult to plug in and pull out, the boom pin fails to be plugged in or pulled out resulting from an inaccurate release position of the boom pin or the like.

SUMMARY OF THE INVENTION

In view of this, the technical problem to be solved in the present invention is to provide a telescopic device of single-cylinder latch type and a crane, which can be used for reducing the influence of flexural deformation of a telescopic boom on plug-in and pull-out of a boom pin.

To this end, embodiments of the present invention adopt the following technical solutions:

the embodiments of the present invention provide a telescopic device of single-cylinder latch type for a telescopic boom system, wherein the telescopic device of single-cylinder latch type includes:

a telescopic cylinder, for driving telescopic boom sections of the telescopic booth system to execute a telescopic action relative to a basic boom section;

double boom pin structures, arranged on both sides of the tails of the telescopic boom sections to lock and unlock the telescopic boom sections;

an boom pin pulling and plugging mechanism, arranged on the cylinder barrel of the telescopic cylinder to execute pulling and plugging operations on the double boom pin structures; and a cylinder pin structure and a cylinder pin cylinder, both arranged on the cylinder barrel of the telescopic cylinder to lock and unlock the cylinder barrel of the telescopic cylinder and the telescopic boom sections.

Further, the double boom pin structures are symmetrically arranged on left and right sides of the tails of the telescopic boom sections.

Further, the boom pin pulling and plugging mechanism includes: an boom pin cylinder, a reset mechanism, a double boom pin pulling device and a transmission mechanism, wherein the boom pin cylinder, the reset mechanism and the double boom pin pulling device are connected with the transmission mechanism, and the transmission mechanism is configured to convert a linear telescopic motion of the boom pin cylinder into a linear pin pulling or releasing action of the double boom pin pulling device on the double boom pin structures.

Further, the transmission mechanism is a link mechanism, including a first link, a second link, a third link and a fourth link, wherein one end of the boom pin cylinder and one end of the reset mechanism are respectively hinged with both ends of the first link; the second link is fixedly connected with the first link, the first link is configured to convert the linear telescopic motion of the boom pin cylinder into a rotary motion of the second link; one end of the third link and one end of the fourth link are respectively hinged with both ends of the second link; the other end of the third link and the other end of the fourth link are respectively hinged with the double boom pin pulling device; the third link and the fourth link are configured to convert the rotary motion of the second link into the linear pin pulling or releasing action of the double boom pin pulling device.

Further, a cylinder barrel end of the boom pin cylinder is fixed on the cylinder barrel of the telescopic cylinder, and a piston rod end of the boom pin cylinder is hinged with one end of the first link.

Further, the reset mechanism includes a first reset spring and a guide mechanism, wherein the guide mechanism guides the extension and retraction of the first reset spring.

Further, the boom pin in the double boom pin structures includes:

a mounting seat, having a hollow inner cavity;

an end cover, arranged at one end of the mounting seat;

a pin, arranged in the hollow inner cavity of the mounting seat and for sliding in the hollow inner cavity of the mounting seat to extend out or retract from the other end of the mounting seat; and an adjusting bolt, passing through the end cover so as to be fixedly connected with the pin and driving the pin to slide in the hollow inner cavity of the mounting seat under an external force.

Futher, at least one second reset spring is further arranged between the end cover and the pin.

Further, the pin is provided with a lubricating nipple and a lubricating oil way communicating the lubricating nipple with the hollow inner cavity of the mounting seat, for inputting lubricating grease to the pin and the hollow inner cavity of the mounting seat through the lubricating nipple, so as to guarantee the lubricating contact of the pin and the hollow inner cavity of the mounting seat.

Further, the pin is provided with a pin pulling hole and a pin pulling bolt inserted in the pin pulling hole, a fixing rod is arranged on the end cover to extend into the pin pulling hole and is threadedly connected with one end of the pin pulling bolt, the other end of the pin pulling bolt is clamped in the pin pulling hole, and the pin retracts relatively to the mounting seat by tightening the pin pulling bolt.

Further, a through hole is opened in the pin, an inner sleeve is fixedly arranged in the through hole, the adjusting bolt is threadedly connected with the inner sleeve, and the adjusting bolt is rotated to change the extension of the pin relative to the mounting seat.

Further, the transmission mechanism converts linear extension of a piston rod of the boom pin cylinder into the linear pin pulling action of the double boom pin pulling device on the double boom pin structures; and a rod cavity of the boom pin cylinder is communicated with a rod cavity of the cylinder pin cylinder, and a rodless cavity of the boom pin cylinder is communicated with a rodless cavity of the cylinder pin cylinder.

Further, the transmission mechanism converts linear retraction of the piston rod of the boom pin cylinder into the linear pin pulling action of the double boom pin pulling device on the double boom pin structures; and the rod cavity of the boom pin cylinder is communicated with the rodless cavity of the cylinder pin cylinder, and the rodless cavity of the boom pin cylinder is communicated with the rod cavity of the cylinder pin cylinder.

Further, the telescopic device of single-cylinder latch type further includes a plurality of hydraulic control valves, which are respectively:

a first hydraulic control valve, arranged on oil supply paths and oil return paths of the oil cavities of the cylinder pin cylinder and the boom pin cylinder, for performing oil supply-return switch on the cylinder pin cylinder and the boom pin cylinder;

a second hydraulic control valve, arranged on the oil supply path of the oil cavity of the cylinder pin cylinder, for controlling pin pulling and releasing actions of the cylinder pin structure on the piston rod of the cylinder pin cylinder; and a third hydraulic control valve, arranged on the oil supply path of the oil cavity of the boom pin cylinder, for controlling the pin pulling and releasing actions of the double boom pin structures by the double boom pin pulling device corresponding to the boom pin cylinder; and in control of the plurality of hydraulic control valves, the second hydraulic control valve and the third hydraulic control valve are configured to be energized at different time; in a pull-out action state of the cylinder pin structure, the first hydraulic control valve and the second hydraulic control valve are energized; in a pull-out action state of the double boom pin structures, the first hydraulic control valve and the third hydraulic control valve are energized; and in a release state of the cylinder pin structure and the double boom pin structures, the first hydraulic control valve is de-energized.

The embodiments of the present invention further provide a crane, including a telescopic boom system and the foregoing telescopic device of single-cylinder latch type.

The technical effects of the above technical solutions are analyzed as follows:

in the present invention, the double boom pin structures are arranged on both sides of the tails of the telescopic boom sections, compared with the existing upper boom pin solution, the double boom pin structures in the present invention are arranged on both sides of the telescopic boom sections, so that the stress is more uniform compared with a structure which is singly arranged on the upper side of a telescopic boom, and the influence of the flexural deformation of a telescopic boom on the position of a pin hole and the stress of the boom pin is reduced; and since the flexural deformation of the telescopic boom mainly occurs on upper and lower sides, the double boom pin structures are symmetrically arranged on the left and right sides of the tails of the telescopic boom sections, and then the pin holes are located in the secondary flexural side face of the telescopic boom, therefore the influence of the flexural deformation of the telescopic boom on the position of the pin hole and the stress of the boom pin is further reduced.

DETAILED DESCRIPTION OF THE EMBODIMENTS

A further detailed description of technical solutions of the present invention will be given below in combination with accompanying drawings and embodiments.

Figure 1:
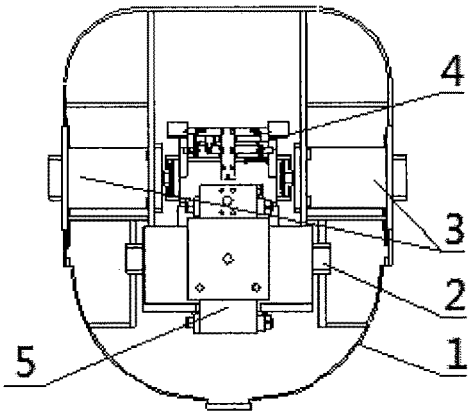
FIG.1 is a schematic diagram of assembly of an embodiment of a telescopic device of single-cylinder latch type in the present invention.

A telescopic device of single-cylinder latch type provided by the present invention is applied to a telescopic boom system and mainly includes a telescopic cylinder, double boom pin structures, a boom pin pulling and plugging mechanism, a cylinder pin structure and a cylinder pin cylinder. As shown in FIG. 1, it is a schematic diagram of assembly of an embodiment of the telescopic device of single-cylinder latch type in the present invention. In the embodiment, the telescopic cylinder 5 of the telescopic device of single-cylinder latch type is adapted to drive telescopic boom sections 1 of the telescopic boom system to execute a telescopic action relative to a basic boom section. The double boom pin structures 3 are arranged on both sides of the tails of the telescopic boom sections to lock and unlock the telescopic boom sections 1. The boom pin pulling and plugging mechanism 4 is arranged on the cylinder barrel of the telescopic cylinder 5 to execute pulling and plugging operations on the double boom pin structures 3. The cylinder pin structure 2 and the cylinder pin cylinder are arranged on the cylinder barrel of the telescopic cylinder 5 to lock and unlock the cylinder barrel of the telescopic cylinder 5 and the telescopic boom sections 1.

In the embodiment, the double boom pin structures are adopted, the double boom pin structures are arranged on both sides of the tails of the telescopic boom sections, compared with a single-point fixing manner of an existing upper boom pin solution, the structural stress of a two-point fixing manner is more uniform, and the influence of flexural deformation of a telescopic boom on the position of a pin hole and the stress of an boom pin can be reduced.

It can be seen from the embodiment as shown in FIG. 1 that, two boom pins of the double boom pin structures can be symmetrically arranged on left and right sides of the tails of the telescopic boom sections, corresponding pin holes are located at the left and right sides of the telescopic boom sections, the flexural deformation of the telescopic boom mainly occurs on upper and lower sides, and the pin holes formed in the secondary flexural side face of the telescopic boom are scarcely influenced by the flexural deformation of the telescopic boom, therefore the influence of the flexural deformation of the telescopic boom on the position of the pin hole and the stress of the boom pin can be further reduced, the boom pin and the pin hole in the telescopic boom are aligned more easily, and the problem of pulling and plugging failure of the boom pin caused by misalignment of the boom pin and the pin hole is avoided.

Figure 2:
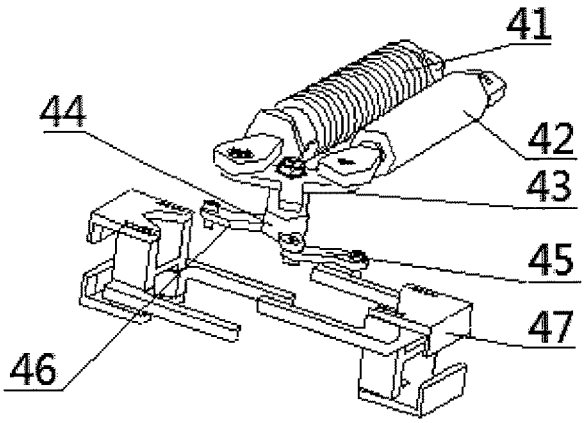
FIG.2 is a schematic diagram of a breakdown structure of a boom pin pulling and plugging mechanism in the embodiment of the telescopic device of single-cylinder latch type in the present invention.

FIG. 2 shows a specific structure of a boom pin pulling and plugging mechanism. The boom pin pulling and plugging mechanism includes: a boom pin cylinder 42, a reset mechanism 41, a double boom pin pulling device 47 and a transmission mechanism. The boom pin cylinder 42, the reset mechanism 41 and the double boom pin pulling device 47 are connected with the transmission mechanism. The transmission mechanism is configure to convert a linear telescopic motion of the boom pin cylinder 42 into a linear pin pulling or releasing action of the double boom pin pulling device 47 on the double boom pin structures 3.

Figure 3:
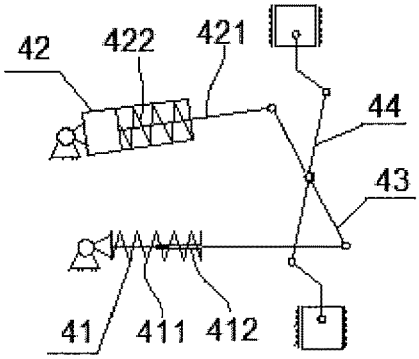
FIG.3 is a schematic diagram of a principle of the boom pin pulling and plugging mechanism as shown in FIG.2.

By means of the reset mechanism 41, the pin pulling and releasing actions of the double boom pin structures can be completed by adopting only a single boom pin cylinder 42, and moreover, since the pin pulling direction of the double boom pin structures and the telescopic direction of the boom pin cylinder are different, the transmission mechanism needs to convert the motion relation thereof. The transmission mechanism can adopt a variety of existing feasible methods. FIG. 2 shows a form of a link mechanism serving as the transmission mechanism, and FIG. 3 is a schematic diagram of a principle corresponding to the link mechanism. The link mechanism includes a first link 43, a second link 44, a third link 45 and a fourth link 46. One end of the boom pin cylinder 42 and one end of the reset mechanism 41 are respectively hinged with both ends of the first link 43. The second link 44 is fixedly connected with the first link 43. The first link 43 is configured to convert the linear telescopic motion of the boom pin cylinder 42 into a rotary motion of the second link 44. One end of the third link 45 and one end of the fourth link 46 are respectively hinged with both ends of the second link 44. The other end of the third link 45 and the other end of the fourth link 46 are respectively hinged with the double boom pin pulling device 47. The third link 45 and the fourth link 46 are configured to convert the rotary motion of the second link 44 into the linear pin pulling or releasing action of the double boom pin pulling device 47. In this way, the linear telescopic motion of the boom pin cylinder 42 is converted into the linear pin pulling or releasing action of the double boom pin pulling device 47 on the double boom pin structures 3 through the link mechanism.

The double boom pin pulling device 47 includes two T-shaped groove structures, which respectively correspond to the double boom pin structures, and the pin pulling operation is achieved by the traction of the T-shaped groove structures on the double boom pins. Under the drive of a single boom pin cylinder 42, the two T-shaped groove structures respectively hinged with the third link 45 and the fourth link 46 are adapted to synchronously pull pins from the double boom pin structures, and thus compared with the solution of adopting two boom pin cylinders in the existing upper boom pin solution, the synchronism is better. Moreover, the boom pin cylinder 42 does not directly act on the T-shaped groove structures and merely bears a positive force, therefore such problems as oil leakage and the like of the cylinder caused by an unbalance loading force applied to the boom pin cylinder are effectively avoided.

In addition, in implementation, the cylinder barrel end of the boom pin cylinder 42 can be fixed on the cylinder barrel of the telescopic cylinder 5, and the piston rod end of the boom pin cylinder is hinged with one end of the first link 43.

The reset mechanism is adapted to recover the boom pin pulling and plugging mechanism to a boom pin release state. The reset mechanism includes a first reset spring 411 and a guide mechanism 412. The first reset spring 411 provides a reset elastic force, and the guide mechanism 412 can guide the extension and retraction of the first reset spring 411. An example of the guide mechanism 412 in which a sleeve at the middle of the first reset spring 411 cooperates with a guide rod can be seen from FIG. 3.

Figure 4:
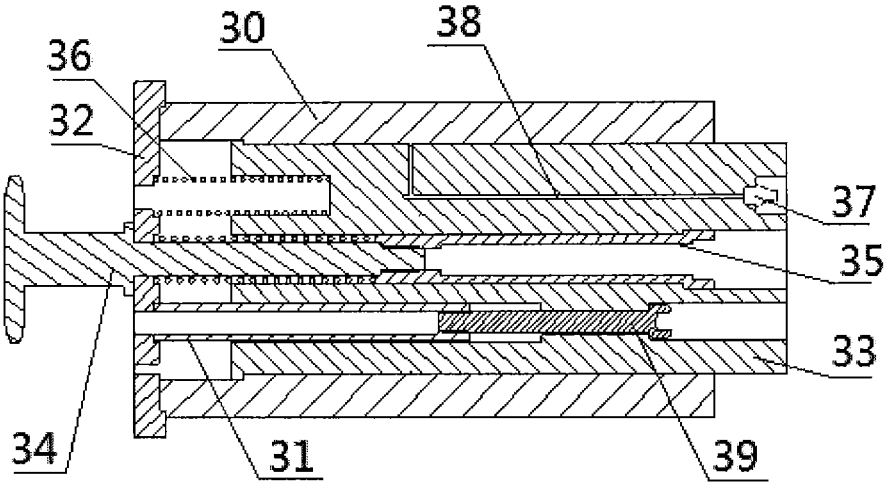
FIG.4 is a schematic diagram of a breakdown structure of a boom pin in the embodiment of the telescopic device of single-cylinder latch type in the present invention.

The structure of the boom pin in the double boom pin structures will be illustrated, below. The boom pin at least includes: a mounting seat, an end cover, a pin and an adjusting bolt or the like. In the example of the boom pin as shown in FIG. 4, the mounting seat 30 of the double boom pin structures 3 is provided with a hollow inner cavity, the end cover 32 is arranged at one end of the mounting seat 30, and the pin 33 is arranged in the hollow inner cavity of the mounting seat 30 and slides in the hollow inner cavity to extend out or retract from the other end of the mounting seat 30. The adjusting bolt 34 passes through the end cover 32 so as to be fixedly connected with the pin 33 and can drive the pin to slide in the hollow inner cavity of the mounting seat 30 under an external force.

The adjusting bolt 34 is provided with a T-shaped head for cooperating with the T-shaped groove structure of the double boom pin pulling device 47. Of course, in another embodiment, the adjusting bolt and the double boom pin pulling device can also adopt cooperation structures in other shapes, for example, a taper or the like, or the adjusting bolt is formed as the T-shaped groove structure, and the double boom pin pulling device is formed as the T-shaped head, etc.

In the double boom pin structures 3, the end cover 32 can seal the hollow inner cavity of the mounting seat 30 and can also limit the motion space of the pin 33 if necessary, and of course, arrangement of some structures can also be performed on the end cover 32. The hollow inner cavity of the mounting seat 30 is required to form clearance fit with the pin 33, so as to enable the pin 33 to extend and retract relatively to the mounting seat 30. A structure limiting the motion space of the pin 33 can also be arranged in the hollow inner cavity of the mounting seat 30, for example, a step or a stop dog, etc.

A through hole can be opened on the pin 33 to form the fixed connection of the adjusting bolt 34 and the pin 33, an inner sleeve 35 is arranged in the through hole, the inner sleeve 35 can be directly fixed in the through hole and can also be clamped in the through hole through a step structure, and internal threads can be arranged on a part of segments of the inner sleeve 35 to form threaded connection with external threads of the adjusting bolt 34. The adjusting bolt 34 is rotated to adjust a distance relative to the inner sleeve 35, and then the extension of the pin 33 can be further adjusted.

The double boom pin pulling device 47 can apply a force on the adjusting bolt 34 to pull in and push out the pin 33 from the hollow inner cavity of the mounting seat 30, or the double boom pin pulling device 47 only applies the force on the adjusting bolt 34 to pull the pin into the hollow inner cavity of the mounting seat 30. At least one second reset spring 36 is arranged between the end cover 32 and the pin 33, and the second reset spring 36 is adapted to push out the pin 33 from the hollow inner cavity of the mounting seat 30. The at least one second reset spring 36 arranged between the end cover 32 and the pin 33 is preferably distributed and arranged uniformly.

To guarantee the lubricating contact of the pin 33 and the hollow inner cavity of the mounting seat 30, the pin 33 is provided with a lubricating nipple 37 and a lubricating oil way 38 communicating the lubricating nipple 37 with the hollow inner cavity of the mounting seat 30, and an operator can input lubricating grease into a gap between the pin 33 and the hollow inner cavity of the mounting seat 30 through the lubricating nipple 37.

The pin 33 is provided with a pin pulling hole and a pin pulling bolt 39 inserted in the pin pulling hole. A fixing rod 31 is arranged on the end cover 32 to extend into the pin pulling hole and is threadedly connected with one end of the pin pulling bolt 39, and the other end of the pin pulling bolt 39 is clamped in the pin pulling hole. The operator can tighten the pin pulling bolt 39 to enable the pin 33 to retract relatively to the mounting seat 30, so as to conveniently and manually pull out the pin.

With the telescopic boom system of the crane as an example, when the telescopic device of single-cylinder latch type in the present invention needs to perform an telescopic boom section extension operation, the cylinder pin is inserted into the cylinder pin hole of a telescopic boom section to be extended out according to a detection signal firstly, then the boom pin is pulled off, the telescopic cylinder extends out with the telescopic boom section, the boom pin is released after arriving at a target position, and then the cylinder pin is pulled out to complete an telescopic boom section extension action; and when retracting the telescopic boom section, the cylinder pin is inserted into the cylinder pin hole of the telescopic boom section to be retracted according to the detection signal, then the boom pin is pulled off, the telescopic cylinder retracts with the telescopic boom section, the boom pin is released after arriving at the target position, and then the cylinder pin is pulled out to complete an telescopic boom section retraction action.

To achieve a control process of the telescopic boom system and achieve an interlocking function of the cylinder pin and the boom pin, hydraulic limitation can be considered. While this limitation can be achieved by coordinating the connectivity of the boom pin cylinder and the cylinder pin cylinder. Since the pin pulling and releasing actions of the boom pin structures corresponding to the extension and retraction of the piston rod of the boom pin cylinder are determined by the transmission mechanism, when the transmission mechanism converts the linear extension of the piston rod of the boom pin cylinder into the linear pin pulling action of the double boom pin pulling device on the double boom pin structures, it means that in an oil filling process of a rodless cavity of the boom pin cylinder, the double boom pin structures perform the pin pulling action, and in the oil filling process of a rod cavity, the double boom pin structures perform a release action (namely, plugging the pin). In this case, the rod cavity of the boom pin cylinder can be communicated with a rod cavity of the cylinder pin cylinder, and the rodless cavity of the boom pin cylinder is communicated with a rodless cavity of the cylinder pin cylinder. Since the piston rod of the cylinder pin cylinder is a cylinder pin structure, the extension of the piston rod thereof is the pin plugging action, and the retraction of the piston rod corresponds to the pin pulling action, therefore by adopting this communication relation, in a simultaneous oil filling process of the rod cavities of the boom pin cylinder and the cylinder pin cylinder, the pin plugging action of the double boom pin structures and the pin pulling action of the cylinder pin structure are performed at the same time; and on the contrary, in the simultaneous oil filling process of the rodless cavities of the boom pin cylinder and the cylinder pin structure, the pin pulling action of the double boom pin structures and the pin plugging action of the cylinder pin structure are performed at the same time.

Correspondingly, if the transmission mechanism converts the linear retraction of the piston rod of the boom pin cylinder into the linear pin pulling action of the double boom pin pulling device on the double boom pin structures and the extension of the piston rod corresponds to the pin plugging action of the boom pin structures, the oil cavity communication relation of the boom pin cylinder and the cylinder pin cylinder needs to be changed correspondingly, namely the rod cavity of the boom pin cylinder is communicated with the rodless cavity of the cylinder pin cylinder, and the rodless cavity of the boom pin cylinder is communicated with the rod cavity of the cylinder pin cylinder. The specific principle can refer to the foregoing condition, and will not be described herein in detail.

Figure 5:
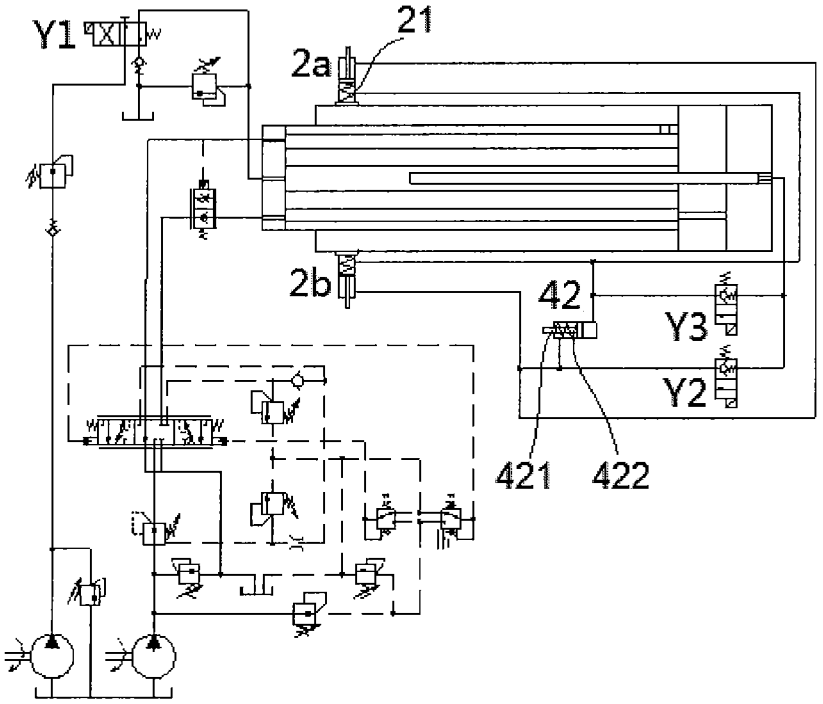
FIG.5 is a schematic diagram of an electrohydraulic control principle in the embodiment of the telescopic device of single-cylinder latch type in the present invention.

Besides the hydraulic limitation, electric control can also be limited. As shown in FIG. 5, a plurality of hydraulic control valves are further additionally arranged on the telescopic device of single-cylinder latch type in the present invention, which are respectively: a first hydraulic control valve Y1, a second hydraulic control valve Y2 and a third hydraulic control valve Y3. The first hydraulic control valve Y1 is arranged on oil supply paths and oil return paths of the oil cavities of cylinder pin cylinders 2*a*, 2*b* and the boom pin cylinder 42 and adapted to perform oil supply-return switch on the cylinder pin cylinders 2*a*, 2*b* and the boom pin cylinder 42. The second hydraulic control valve Y2 is arranged on the oil supply path of the oil cavity of the cylinder pin cylinder and adapted to control the pin pulling and releasing actions of the cylinder pin structure on the piston rod of the cylinder pin cylinder. The third hydraulic control valve Y3 is arranged on the oil supply path of the oil cavity of the boom pin cylinder and adapted to control the pin pulling and releasing actions of the double boom pin structures by the double boom pin pulling device corresponding to the boom pin cylinder. All of these hydraulic control valves can be achieved by electromagnetic directional valves.

The first hydraulic control valve Y1 controls the oil supply-return switch of the cylinder pin cylinders 2*a*, 2*b* and the boom pin cylinder 42, and the second hydraulic control valve Y2 controls the cylinder pin cylinders 2*a*, 2*b* to pull out and plug in the cylinder pin structure. When pulling out the cylinder pin, the first hydraulic control valve Y1 and the second hydraulic control valve Y2 are at an energized state, high pressure oil enters the small cavities of the cylinder pin cylinders 2*a*, 2*b* to drive the cylinder pin structure to pull out the cylinder pin from the pin hole, meanwhile, the high pressure oil will enter the small cavity of the boom pin cylinder 42 and provide a reactive force together with the third reset spring 422 to keep the boom pin at an extension state.

The third hydraulic control valve Y3 controls the pull-out and plug-in of the boom pin cylinder 42. When the boom pin is pulled out, the first hydraulic control valve Y1 and the third hydraulic control valve Y3 are at the energized state, the high-pressure oil enters the large cavity of the boom pin cylinder 42 to drive the boom pin pulling and plugging mechanism to pull out the boom pin, meanwhile, the high pressure oil will enter the large cavity of the cylinder pin cylinder and provide the reactive force together with the third reset spring 422 to keep the cylinder pin at the extension state. The cylinder pin or the boom pin can be released in safety, as long as the first hydraulic control valve Y1 is de-energized, the cylinder pin or the boom pin can automatically reset.

In summary, in control of these hydraulic control valves, the second hydraulic control valve and the third hydraulic control valve are configured to be energized at different time. Even if the second hydraulic control valve and the third hydraulic control valve are simultaneously energized, since the action area of the rodless cavity of the cylinder pin cylinder is larger than that of the rod cavity and the acting force of the fourth reset spring 21 of the cylinder pin cylinder is exerted on the cylinder pin, the cylinder pin is kept at a plug-in state, so as to guarantee the use safety. In a pull-out action state of the cylinder pin structure, the first hydraulic control valve and the second hydraulic control valve are energized, and in the pull-out action state of the double boom pin structures, the first hydraulic control valve and the third hydraulic control valve are energized. In a release state of the cylinder pin structure and the double boom pin structures, the first hydraulic control valve is de-energized. In this way, the telescopic device of single-cylinder latch type provided by the present invention achieves dual hydraulic and electric interlocking, and thus the safe and reliable operation of the telescopic arm system is guaranteed.

The above-mentioned embodiment of the telescopic device of single-cylinder latch type provided by the present invention is applicable to a variety of engineering apparatuses with telescopic arm systems, for example, a crane. By adopting the telescopic device of single-cylinder latch type, the telescopic operation of a telescopic boom can be more reliable and is more operable.

The foregoing descriptions are merely preferred implementations of the present invention, it should be noted that, those of ordinary skill in the art can make a variety of improvements and modifications without departing from the principle of the present invention, and these improvements and modifications should fall into the scope of protection of the present invention.

The invention claimed is:

1. A telescopic device of single-cylinder latch type for a telescopic boom system, comprising:

a telescopic cylinder, for driving telescopic boom sections of the telescopic boom system to execute a telescopic action relative to a basic boom section;

double boom pin structures, arranged on both sides of tails of the telescopic boom sections to lock and unlock the telescopic boom sections;

a boom pin pulling and plugging mechanism, arranged on the cylinder barrel of the telescopic cylinder to execute pulling and plugging operations on the double boom pin structures; and a cylinder pin structure and a cylinder pin cylinder, both arranged on the cylinder barrel of the telescopic cylinder and configured to lock and unlock the cylinder barrel of the telescopic cylinder and the telescopic boom sections, wherein the boom pin pulling and plugging mechanism comprises:

a boom pin cylinder, a reset mechanism, a double boom pin pulling device and a transmission mechanism;

the boom pin cylinder, the reset mechanism and the double boom pin pulling device are connected with the transmission mechanism; and the transmission mechanism is configured to convert a linear telescopic motion of the boom pin cylinder into a linear pin pulling or releasing action of the double boom pin pulling device on the double boom pin structures;

wherein the transmission mechanism is a link mechanism, comprising a first link, a second link, a third link and a fourth link; one end of the boom pin cylinder and one end of the reset mechanism are respectively hinged with both ends of the first link; the second link is fixedly connected with the first link; the first link is configured to convert the linear telescopic motion of the boom pin cylinder into a rotary motion of the second link; one end of the third link and one end of the fourth link are respectively hinged with both ends of the second link; the other end of the third link and the other end of the fourth link are respectively hinged with the double boom pin pulling device; and the third link and the fourth link are configured to convert the rotary motion of the second link into the linear pin pulling or releasing action of the double boom pin pulling device.

2. The telescopic device of single-cylinder latch type of claim 1, wherein the double boom pin structures are symmetrically arranged on left and right sides of the tails of the telescopic boom sections.

3. The telescopic device of single-cylinder latch type of claim 1, wherein a cylinder barrel end of the boom pin cylinder is fixed on the cylinder barrel of the telescopic cylinder, and a piston rod end of the boom pin cylinder is hinged with one end of the first link.

4. The telescopic device of single-cylinder latch type of claim 1, wherein the reset mechanism comprises a first reset spring and a guide mechanism, and the guide mechanism guides the extension and retraction of the first reset spring.

5. The telescopic device of single-cylinder latch type of claim 1, wherein a boom pin in the double boom pin structures comprises:

a mounting seat, having a hollow inner cavity;

an end cover, arranged at one end of the mounting seat;

a pin, arranged in the hollow inner cavity of the mounting seat, for sliding in the hollow inner cavity of the mounting seat to extend out or retract from the other end of the mounting seat; and an adjusting bolt, passing through the end cover so as to be fixedly connected with the pin and driving the pin to slide in the hollow inner cavity of the mounting seat under an external force.

6. The telescopic device of single-cylinder latch type of claim 5, wherein at least one second reset spring is further arranged between the end cover and the pin.

7. The telescopic device of single-cylinder latch type of claim 5, wherein the pin is provided with a lubricating nipple and a lubricating oil way communicating the lubricating nipple with the hollow inner cavity of the mounting seat, for inputting lubricating grease to the pin and the hollow inner cavity of the mounting seat through the lubricating nipple, so as to guarantee the lubricating contact of the pin and the hollow inner cavity of the mounting seat.

8. The telescopic device of single-cylinder latch type of claim 5, wherein the pin is provided with a pin pulling hole and a pin pulling bolt inserted in the pin pulling hole, a fixing rod is arranged on the end cover to extend into the pin pulling hole and is threadedly connected with one end of the pin pulling bolt, the other end of the pin pulling bolt is clamped in the pin pulling hole, and the pin retracts relatively to the mounting seat by tightening the pin pulling bolt.

9. The telescopic device of single-cylinder latch type of claim 5, wherein a through hole is opened in the pin, an inner sleeve is fixedly arranged in the through hole, the adjusting bolt is threadedly connected with the inner sleeve, and the adjusting bolt is rotated to change the extension of the pin relative to the mounting seat.

10. The telescopic device of single-cylinder latch type of claim 1, wherein:

the transmission mechanism converts linear extension of a piston rod of the boom pin cylinder into the linear pin pulling action of the double boom pin pulling device on the double boom pin structures, and a rod cavity of the boom pin cylinder is communicated with a rod cavity of the cylinder pin cylinder, and a rodless cavity of the boom pin cylinder is communicated with a rodless cavity of the cylinder pin cylinder; or the transmission mechanism converts linear retraction of the piston rod of the boom pin cylinder into the linear pin pulling action of the double boom pin pulling device on the double boom pin structures, and the rod cavity of the boom pin cylinder is communicated with the rodless cavity of the cylinder pin cylinder, and the rodless cavity of the boom pin cylinder is communicated with the rod cavity of the cylinder pin cylinder.

11. The telescopic device of single-cylinder latch type of claim 10, further comprising a plurality of hydraulic control valves, which are respectively:

a first hydraulic control valve, arranged on oil supply paths and oil return paths of the oil cavities of the cylinder pin cylinder and the boom pin cylinder, for performing oil supply-return switch on the cylinder pin cylinder and the boom pin cylinder;

a second hydraulic control valve, arranged on the oil supply path of the oil cavity of the cylinder pin cylinder, for controlling pin pulling and releasing actions of the cylinder pin structure on the piston rod of the cylinder pin cylinder; and a third hydraulic control valve, arranged on the oil supply path of the oil cavity of the boom pin cylinder, for controlling the pin pulling and releasing actions of the double boom pin structures by the double boom pin pulling device corresponding to the boom pin cylinder; and in control of the plurality of hydraulic control valves, the second hydraulic control valve and the third hydraulic control valve are configured to be energized at different time;

in a pull-out action state of the cylinder pin structure, the first hydraulic control valve and the second hydraulic control valve are energized; in the pull-out action state of the double boom pin structures, the first hydraulic control valve and the third hydraulic control valve are energized; and in a release state of the cylinder pin structure and the double boom pin structures, the first hydraulic control valve is de-energized.

12. A crane comprising a telescopic boom system, wherein the crane comprises the telescopic device of single-cylinder latch type of claim 1.

* * * * *